US008146740B2

(12) United States Patent
Tan

(10) Patent No.: US 8,146,740 B2
(45) Date of Patent: Apr. 3, 2012

(54) HOOK HANDLE ASSEMBLY FOR GOLF BAG

(76) Inventor: Fu-Hsing Tan, Taoyuan Hsien (TW)

( * ) Notice: Subject to any disclaimer, the term of this patent is extended or adjusted under 35 U.S.C. 154(b) by 0 days.

(21) Appl. No.: 11/976,600

(22) Filed: Oct. 25, 2007

(65) Prior Publication Data

US 2011/0253732 A1 Oct. 20, 2011

(51) Int. Cl.
*A63B 55/00* (2006.01)
*A45C 13/26* (2006.01)

(52) U.S. Cl. ..... 206/315.3; 190/18 A; 190/115; 280/DIG. 6; 280/645; 280/47.17

(58) Field of Classification Search ..... 280/DIG. 6, 280/645, 47.17; 190/18 A, 115; 206/315.3
See application file for complete search history.

(56) References Cited

U.S. PATENT DOCUMENTS

| | | | | |
|---|---|---|---|---|
| 3,401,951 | A * | 9/1968 | Bloom | 280/47.17 |
| 5,167,389 | A * | 12/1992 | Reimers | 248/96 |
| 5,671,842 | A * | 9/1997 | Jaworski | 206/315.3 |
| 6,182,983 | B1 * | 2/2001 | Kim | 280/47.26 |
| 6,317,924 | B1 * | 11/2001 | Gallagher | 16/114.1 |
| 6,409,207 | B1 * | 6/2002 | Kuo | 280/655.1 |
| 6,564,426 | B1 * | 5/2003 | Wang | 16/113.1 |
| 2005/0087415 | A1 * | 4/2005 | Gorga et al. | 190/115 |

* cited by examiner

*Primary Examiner* — Tri Mai

(57) ABSTRACT

A hook handle assembly is disclosed to include a mount, which has a first mounting portion affixed to a golf bag and a second mounting portion with positioning grooves protruded from the first mounting portion, a handlebar pivoted to the second mounting portion of the mount and positionable in the positioning grooves of the mount, and a hook grip, which has a mounting block pivoted to one end of handlebar remote from the mount, a hook-like grip body extended from the mounting block for grasping by the user or hooking on a handrail or support, and an adjustable fastener for securing the hook grip in place after hooking of the hook-like grip body on a handrail or support.

1 Claim, 8 Drawing Sheets

HOOK HANDLE ASSEMBLY FOR GOLF BAG

BACKGROUND OF THE INVENTION

1. Field of the Invention

The present invention relates to a hook handle and more specifically, to a hook handle assembly for golf bag.

2. Description of the Related Art

Many gold bags are known having at least one wheel pivotally provided at the bottom, a handlebar provided at one side, and a grip coupled to the handlebar. By means of the grip and the handlebar, the user can carry the at least one wheel to rotate, moving the golf bag on the floor.

The aforesaid handlebar can be of a retractable or foldable design closely attached to the periphery of the golf bag at one side. Because the handlebar is longitudinally closely attached to the periphery of the golf bag at one side, the user's fingers may be jammed or injured accidentally when extending or folding the handlebar. Further, because the handlebar is longitudinally closely attached to the periphery of the golf bag at one side, the handlebar and the grip may hinder the user's action in picking up a golf club from the golf bag, and therefore the user must be very careful when picking up a golf club from the golf bag.

SUMMARY OF THE INVENTION

The present invention has been accomplished under the circumstances in view. It is the main object of the present invention to provide a hook handle assembly for golf bag, which is safe in use and does not hinder access to the golf clubs.

To achieve this and other objects of the present invention, the hook handle assembly installed in a golf bag, comprising:

a mount, the mount comprising a first mounting portion affixed to the golf bag and a second mounting portion protruded from the first mounting portion, the second mounting portion comprising a plurality of positioning grooves;

a handlebar pivoted to the second mounting portion of the mount and positionable in the positioning grooves of the mount, the handlebar comprising two longitudinal rod members arranged in parallel, the longitudinal rod members each having a first end pivoted to the second mounting portion and a second end, and a transverse connection block connected between the second ends of the longitudinal rod members; and a hook grip, the hook grip comprising a mounting block pivoted to the transverse connection block of the handlebar, and a hook-like grip body extended from one end of the mounting block.

DETAILED DESCRIPTION OF THE PREFERRED EMBODIMENT

Figure 1:
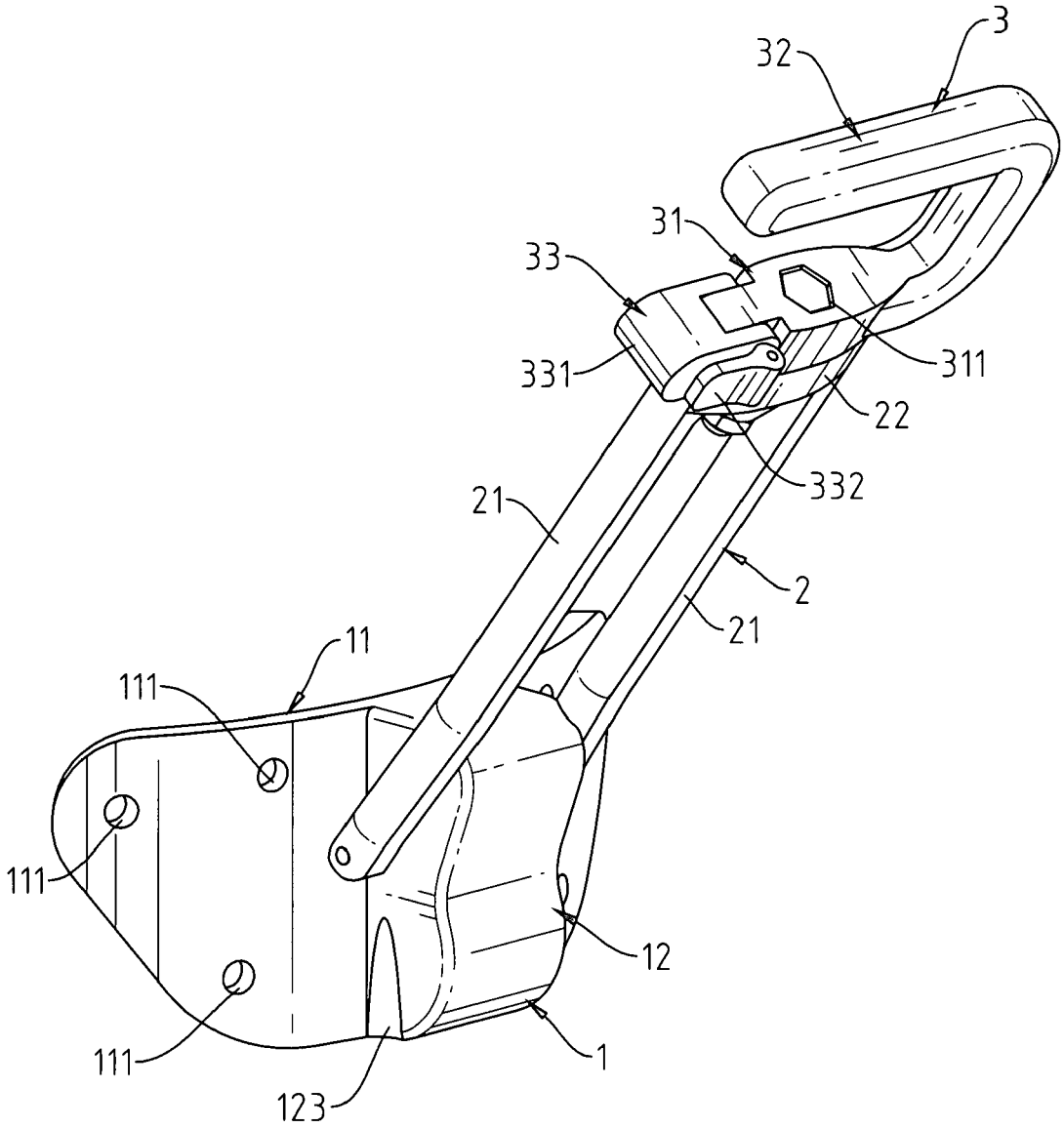
FIG. 1 is a perspective view of a hook handle assembly in accordance with the present invention.
Figure 2:
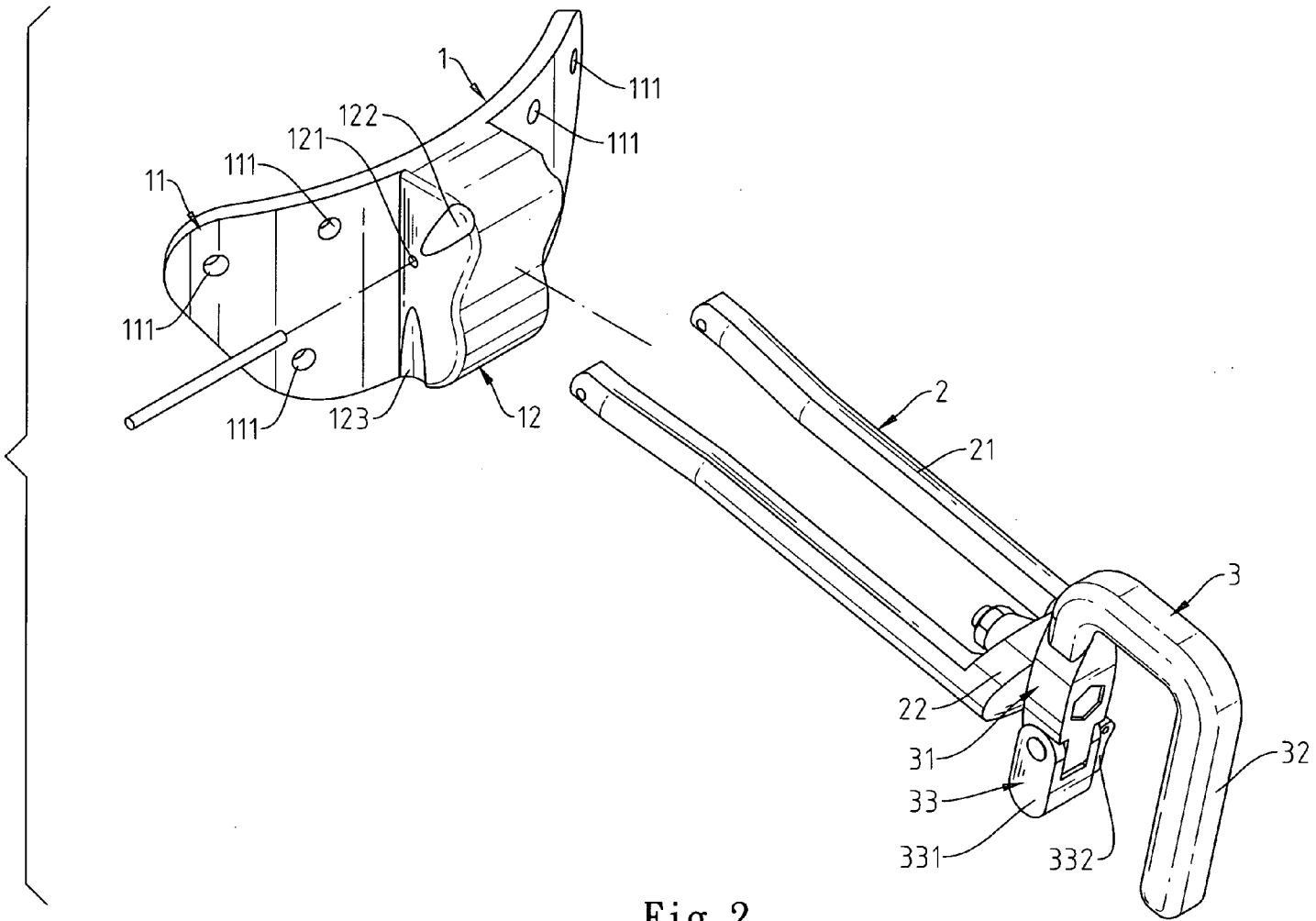
FIG. 2 is an exploded view of the hook handle assembly in accordance with the present invention.
Figure 3:
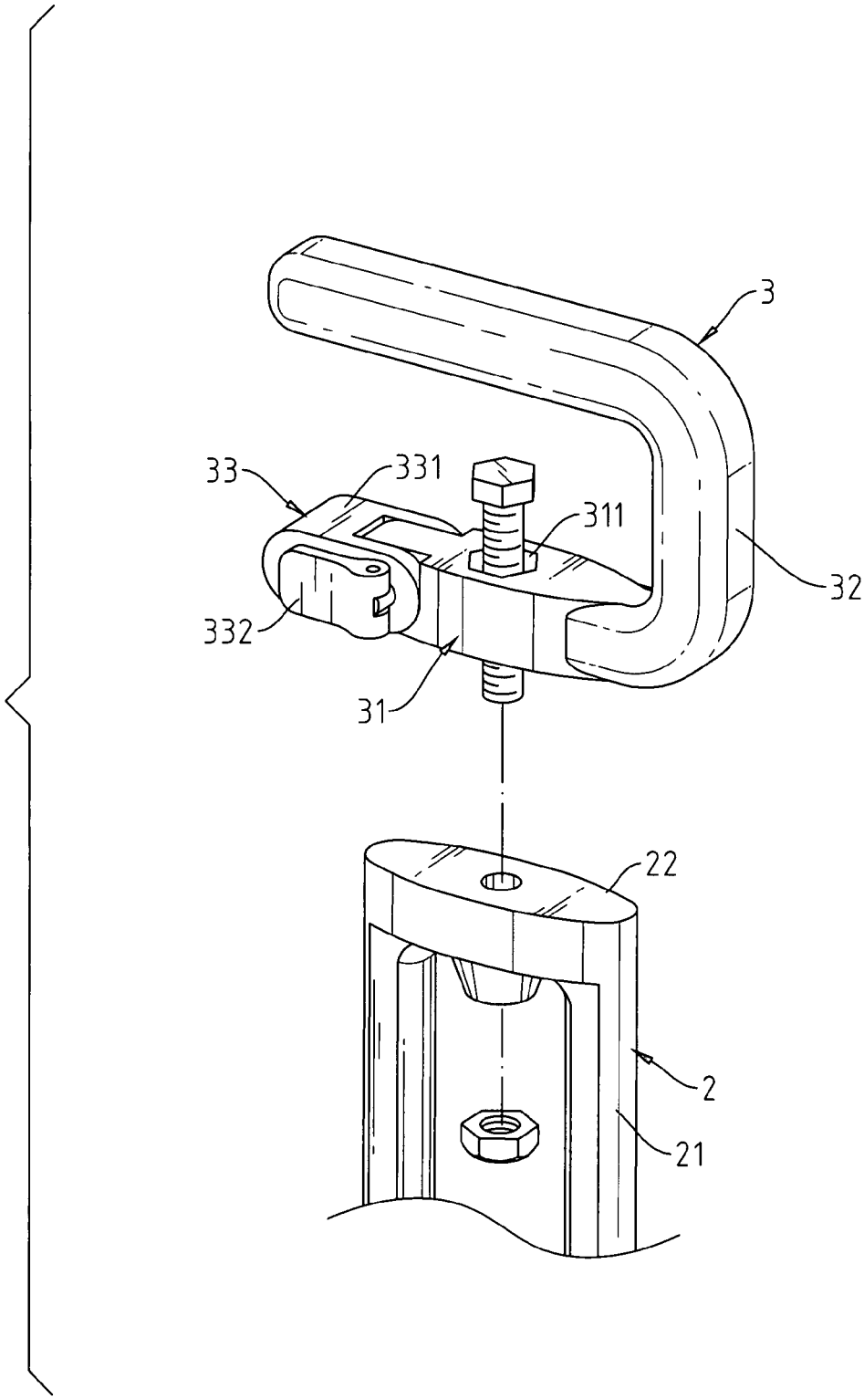
FIG. 3 is an exploded view of a part of the present invention, showing the relative coupling structure between the handlebar and the hook grip.
Figure 4:
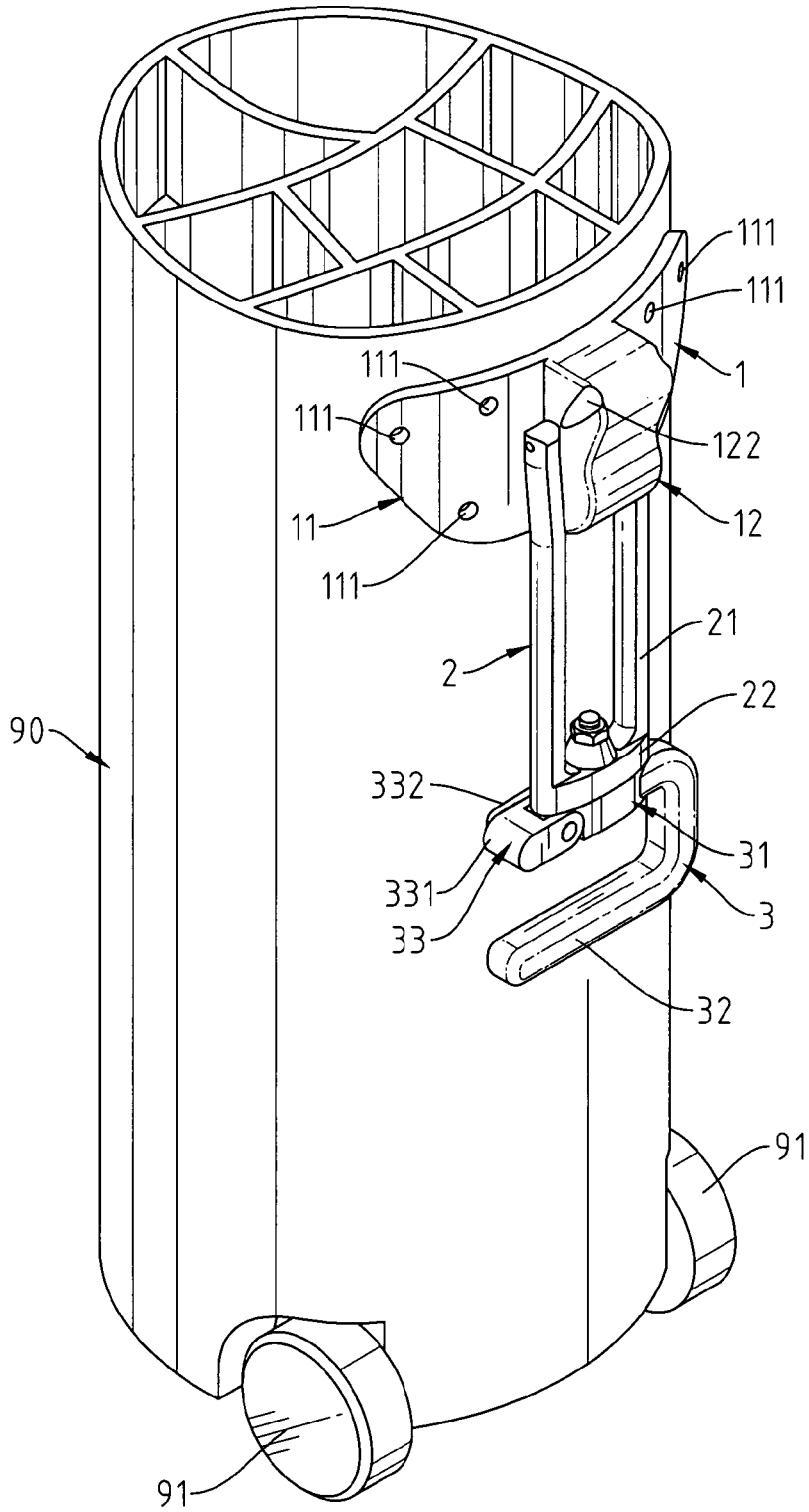
FIG. 4 is an elevational view showing the hook handle assembly installed in a golf bag according to the present invention.

Referring to FIGS. 1~4, a hook handle assembly in accordance with the present invention is shown installed in a golf bag 90, comprised of a mount 1, a handlebar 2, and a hook grip 3.

Referring to FIGS. 1, 2 and 4 again, the mount 1 is affixed to the golf bag 90, comprising a first mounting portion 11 and a second mounting portion 12 protruded from the first mounting portion 11. The first mounting portion 11 comprises a plurality of mounting through holes 111 for fastening to the golf bag 90. The second mounting portion 12 comprises an axle hole 121 transversely cut through two opposite lateral sides thereof on the middle, and two positioning grooves, namely, the first positioning groove 122 and the second positioning groove 123 disposed on each of the two opposite lateral sides at different elevations and extending in different directions. The first positioning grooves 122 slope upwardly outwards at an angle in direction away from the golf bag 90.

Referring to FIGS. 2 and 3 again, the handlebar 2 comprises two longitudinal rod members 21 arranged in parallel and pivotally connected to the two distal ends of the axle hole 121 of the second mounting portion 12 of the mount 1, and a transverse connection block 22 joining the longitudinal rod members 21. The longitudinal rod members 21 can be selectively rested in the first positioning grooves 122 or second positioning grooves 123 of the second mounting portion 12 of the mount 1.

Referring to FIGS. 2 and 3 again, the hook grip 3 is pivoted to the transverse connection block 22 of the handlebar 2, comprising a mounting block 31, a hook-like grip body 32 extended from one end of the mounting block 31, and an adjustable fastener 33 disposed at the other end of the mounting block 31. The mounting block 31 comprises a pivot hole 311 pivotally connected to the transverse connection block 22 of the handlebar 2. The adjustable fastener 33 comprises a movable member 331 and a locking lever 332. The movable member 331 is pivoted to one end of the mounting block 31. The locking lever 332 is coupled to the pivot (not shown) of the movable member 331, and turnable between a locking position where the movable member 331 is locked to the mounting block 31 and the unlocking position where the movable member 311 can be turned relative to the mounting block 31 between a horizontal position in horizontal alignment with the mounting block 31 and a vertical position perpendicular to the mounting block 31.

Figure 5:
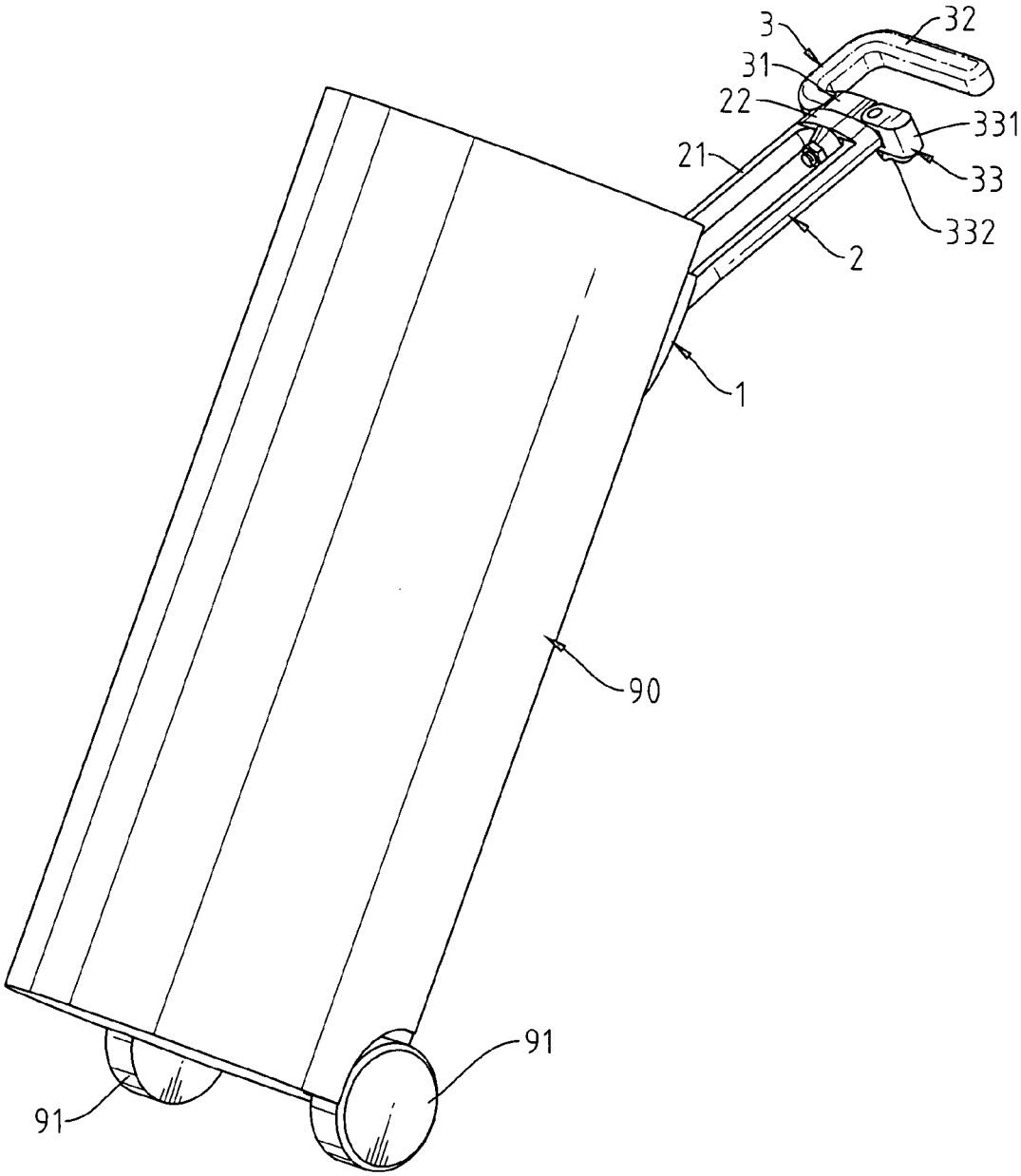
FIG. 5 is a schematic drawing showing the hook handle assembly installed in a golf bag and operated according to the present invention.

Referring to FIG. 5 and FIG. 4 again, the mount 1 is affixed to the golf bag 90, which has its bottom panel equipped with a pair of wheels 91. When wishing to move the golf bag 90 on the floor, lift the handlebar 2 to have the two longitudinal rod members 21 be selectively rested in the first positioning grooves 122 of the second mounting portion 12 of the mount 1, and then tilt the golf bag 90 to have the gravity center of the golf bag 90 be shifted to the wheels 91. At this time, the user can pull the hook grip 3 to move the golf bag 90 on the floor by means of the wheels 91.

Figure 6:
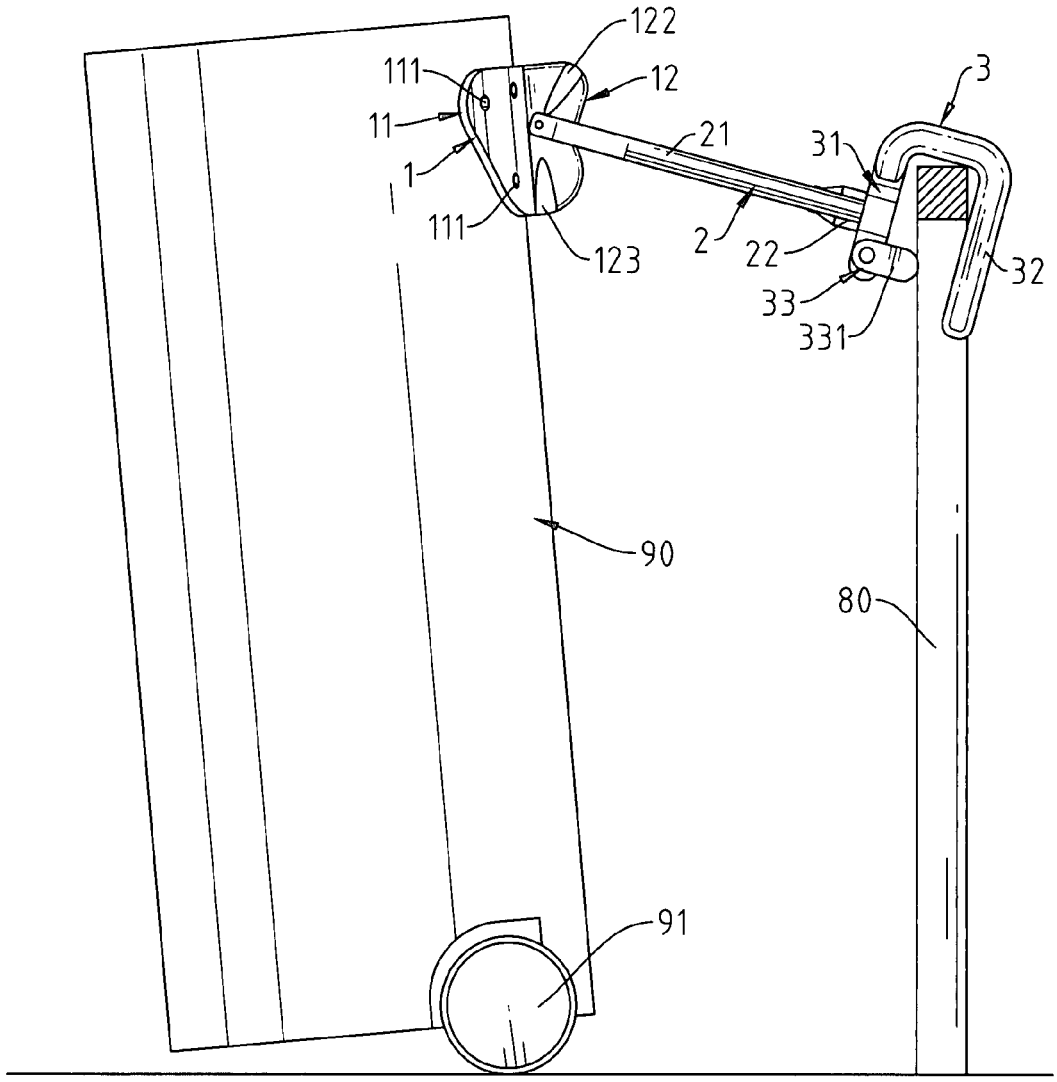
FIG. 6 is a schematic drawing showing the hook handle assembly installed in a golf bag and hooked on a handrail according to the present invention.
Figure 7:
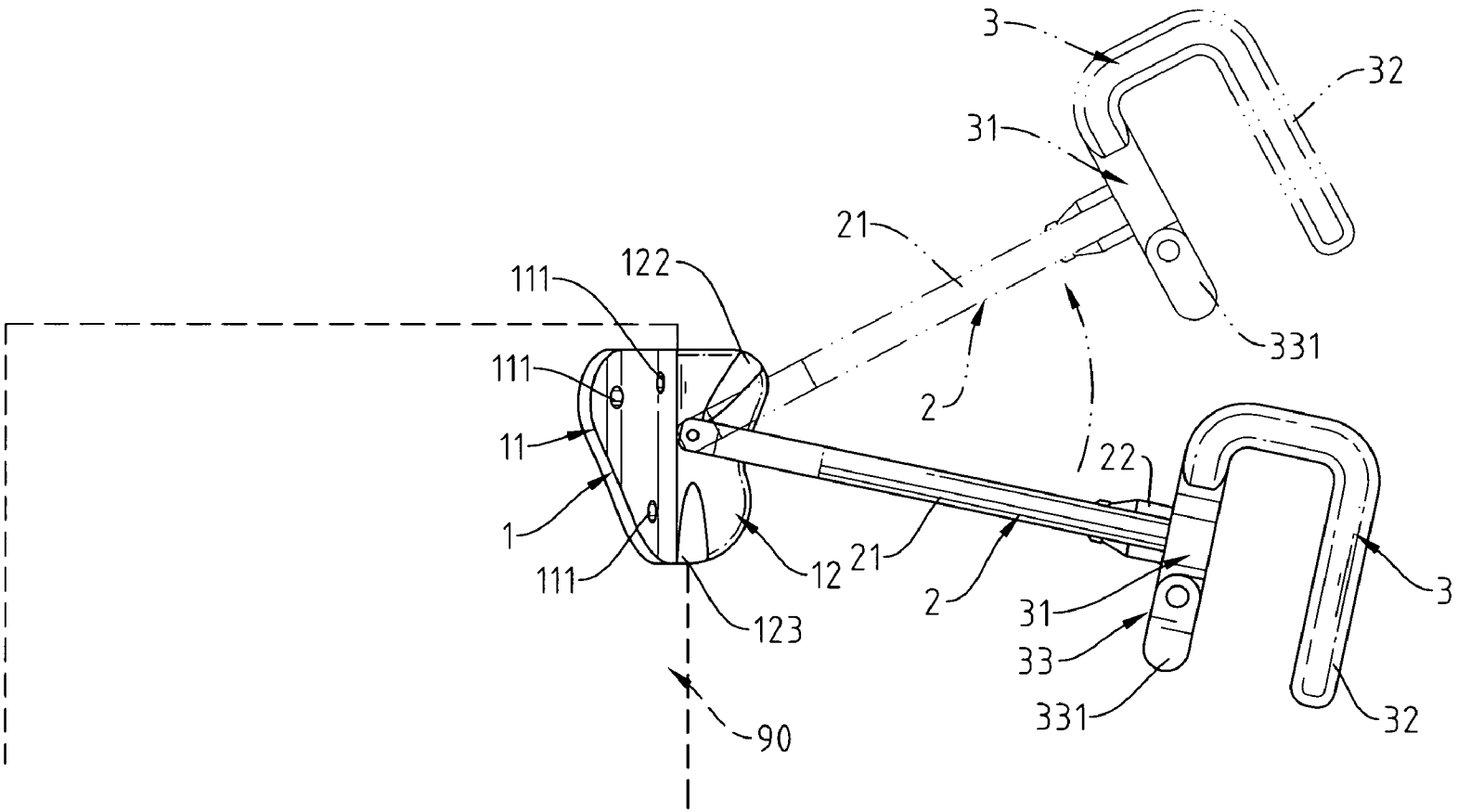
FIG. 7 is a schematic drawing showing the hook handle assembly installed in a golf bag and the angle of the handlebar adjusted relative to the golf bag according to the present invention.
Figure 8:
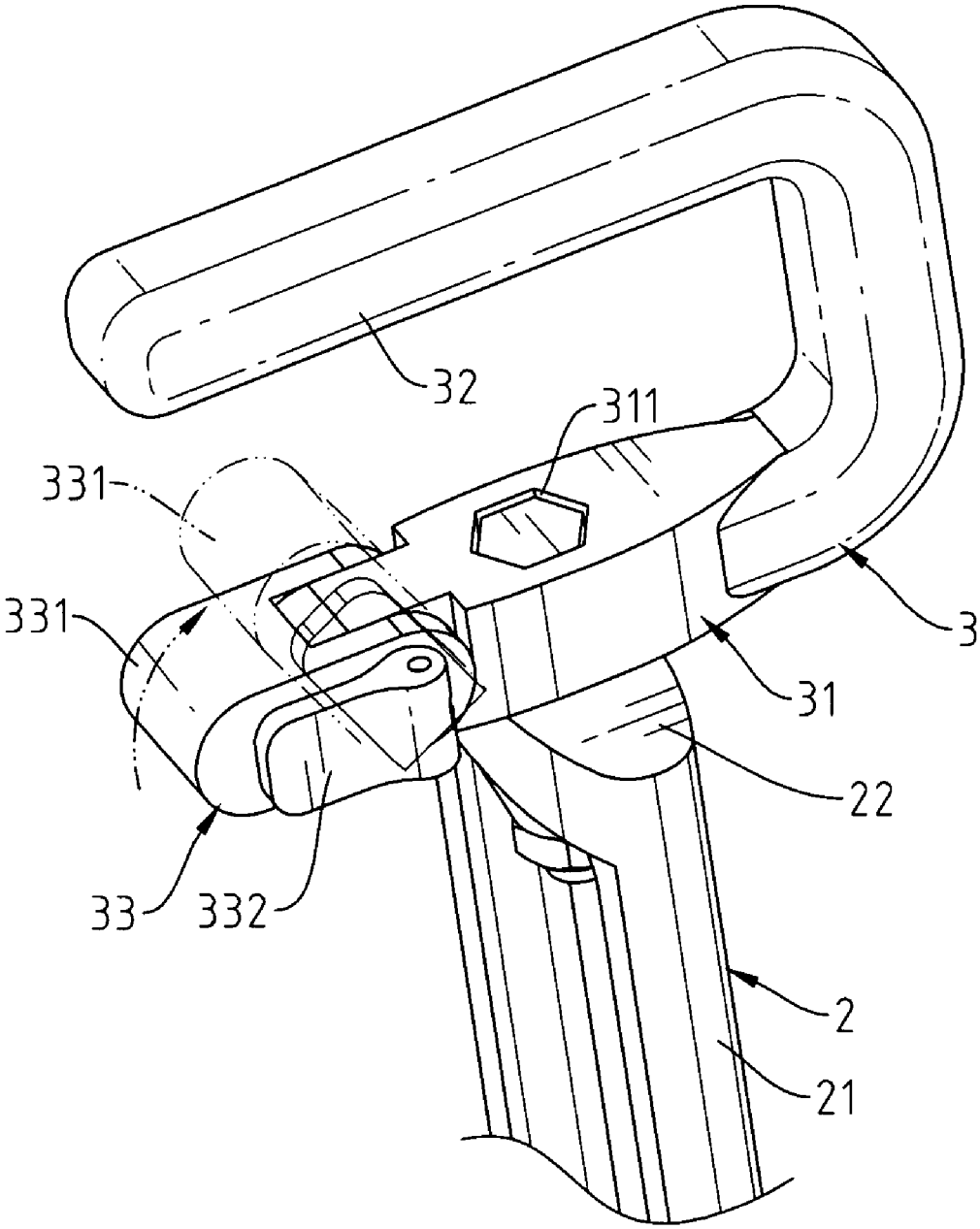
FIG. 8 is a schematic drawing of the present invention showing adjustment of the adjustable fastener.

Referring to FIGS. 6~8, the hook grip 3 can be hooked on a support, for example, handrail 80 to hold the golf bag 90 positively in place. In this case, the handlebar 2 is turned outwards from the golf bag 90, and then the hook-like grip body 32 of the hook grip 3 is hooked on the handrail 80, and then the locking lever 332 is turned to the unlocking position to unlock the movable member 331, and then the movable member 331 is turned to the vertical position relative to the mounting block 31 to secure the hook-like grip body 32 to the handrail 80, and then the locking lever 332 is returned to the locking position to lock the movable member 331. When removing the hook grip 3 from the handrail 80, unlock the locking lever 332 and turn the movable member 331 from the vertical position to the horizontal position.

Further, when the two longitudinal rod members 21 of the handlebar 2 are rested in the first positioning grooves 122 of the second mounting portion 12 of the mount 1, the handlebar 2 is held in a tilted and outwardly extending status relative to the golf bag 90. At this time, the user can move the golf bag 90 on the floor by means of the wheels 91.

Further, because the handlebar 2 is pivoted to the golf bag 90 and the hook grip 3 is pivoted to the transverse connection block 22 of the handlebar 2 remote from the golf bag 90, the user can operate the hook handle assembly conveniently without causing finger jam accident. Further, because the first positioning grooves 122 of the second mounting portion 12 of the mount 1 extend upwardly outwards at an angle in direction away from the golf bag 90, the handlebar 2 does no hinder access to the golf clubs carried in the golf bag 90 when the two longitudinal rod members 21 of the handlebar 2 are rested in the first positioning grooves 122. Further, the hook handle assembly can also be installed in a golf bag without any wheel.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A hook handle assembly installed in a golf bag, comprising:

a mount, said mount comprising a first mounting portion affixed to said golf bag and a second mounting portion protruded from said first mounting portion, said second mounting portion comprising a plurality of positioning grooves;

a handlebar pivoted to said second mounting portion of said mount and positionable in said positioning grooves of said mount, said handlebar comprising two longitudinal rod members arranged in parallel, said longitudinal rod members each having a first end pivoted to said second mounting portion and a second end, and a transverse connection block connected between the second ends of said longitudinal rod members; and a hook grip, said hook grip comprising a mounting block pivoted to the transverse connection block of said handlebar, and a hook-like grip body extended from one end of said mounting block;

wherein the positioning grooves of said first mounting portion of said mount include two first positioning grooves disposed at two opposite lateral sides and two second positioning grooves respectively disposed below said first positioning grooves, said second positioning grooves extending upwardly outwards at an angle in a direction away from said golf bag; and wherein said hook grip further comprises an adjustable fastener disposed at one end of said mounting block opposite to said hook-like grip body, said adjustable fastener comprising a movable member pivoted to one end of said mounting block and turnable relative to said mounting block between a horizontal position in horizontal alignment with said mounting block and a vertical position perpendicular to said mounting block, and a locking lever coupled to said movable member and adapted to lock said movable member to said mounting block.

* * * * *